US006929178B2

(12) United States Patent
Moriya et al.

(10) Patent No.: US 6,929,178 B2
(45) Date of Patent: Aug. 16, 2005

(54) CASH STORAGE APPARATUS

(75) Inventors: Masatoshi Moriya, Saitama-ken (JP); Yoshihiko Iwata, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 301 days.

(21) Appl. No.: 10/315,866

(22) Filed: Dec. 10, 2002

(65) Prior Publication Data

US 2003/0116618 A1 Jun. 26, 2003

(30) Foreign Application Priority Data

Dec. 25, 2001 (JP) ..... 2001-390778

(51) Int. Cl.[7] ..... G07G 1/00
(52) U.S. Cl. ..... 235/381; 235/7 R; 235/27
(58) Field of Search ..... 235/381, 382, 235/7 R, 12, 22, 27

(56) References Cited

U.S. PATENT DOCUMENTS 4,412,709 A * 11/1983 Ishii ..... 312/291
4,786,785 A * 11/1988 Felt ..... 235/7 R
5,756,977 A * 5/1998 Biss ..... 235/7 R
5,768,965 A * 6/1998 Gonzalez et al. ..... 83/440

FOREIGN PATENT DOCUMENTS

EP 0313701 * 3/1989 ..... G07G/1/00
JP 11-000232 1/1999

* cited by examiner

*Primary Examiner*—Daniel Stcyr
(74) *Attorney, Agent, or Firm*—Frishauf, Holtz, Goodman & Chick, P.C.

(57) ABSTRACT

In a cash storage apparatus having plural drawers, operation of these drawers is improved. A first and a second drawer, one being stacked on other, are received in a body casing of the cash storage apparatus. The apparatus is provided with a cylinder-lock for locking the first drawer to the body casing and a locking member for locking the second drawer to the body casing when the first drawer is pulled out from the body casing. There is no need to install cylinder-locks to the first and the second drawer respectively. When the cylinder-lock installed on the first drawer is unlocked, the locking member installed on the second drawer may be operated, whereby locking and unlocking operation of the drawers is simplified and improved, and the cash storage apparatus of user friendliness is available.

12 Claims, 9 Drawing Sheets

CASH STORAGE APPARATUS

BACKGROUND OF THE INVENTION

The present invention relates to a cash storage apparatus or a drawer apparatus employed for an electronic cash register.

A conventional electronic cash register is provided with a cash storage apparatus such as a drawer apparatus for storing cash. The drawer apparatus for the electronic cash register is composed of a housing provided under a body of the cash register, a drawer member slidably received in the housing for storing cash, and a cylinder-lock installed on the drawer member for locking the drawer member. The drawer member has plural compartments for storing various kinds of coins and banknotes, respectively.

Since there are some requirements for a space for installation of the electronic cash register, the drawer apparatus received in the housing has also a restriction in its size of the drawer member. As a result, the conventional drawer apparatus has drawbacks that only selected sorts of coins and banknotes are stored in the drawer apparatus due to the limited size of the drawer member, and documents other than cash such as checks and coupon for goods can not be stored.

To solve the above drawbacks, another drawer apparatus has been proposed which has plural drawer members received in the housing and stacked on each other for storing various kinds of banknotes and documents.

However, the above conventional drawer apparatus has another drawbacks that plural cylinder-locks must be provided on the drawer members respectively and employment of the cylinder-lock mechanism on each of the drawer members requires a user to frequently do troublesome unlocking and/or locking operation. As described above, the drawer apparatus has also a disadvantage that it can not be used conveniently.

The advantage of the present invention is to provide a drawer apparatus having plural drawer members which allow effective unlocking and/or locking operation as well as easy and simple manipulation for storing documents therein.

SUMMARY OF THE INVENTION

It is an aspect of the present invention to provide a cash storage apparatus having a housing and at least a first and a second drawer, one being stacked on the other, which are received in and can be pulled out from the housing, comprising: a first locking member for locking the first drawer to the housing, and a second locking member for locking the second drawer to the housing, allowing to unlock the same when the first lock is unlocked and the first drawer is pulled out from the housing.

In the above cash storage apparatus, when the locking member of the second drawer is unlocked with the first drawer being unlocked and pulled out, the second drawer cab be pulled out even if the first drawer is locked with the cylinder-lock, and when the second drawer is locked with the locking member with the first drawer is pulled out, the first drawer can be pulled out but the second drawer can not be pulled out. Therefore, there is no need to install locks to the first and second drawers, respectively, and when the lock is installed on the first drawer and the lock is unlocked, the locking member installed on the second drawer can be operated, whereby locking and unlocking operations of the plural drawers are simplified and improved, and the cash storage apparatus of user friendliness is obtained.

It is another aspect of the present invention is to provide a cash storage apparatus having a housing and at least a first and a second drawer, one being stacked on the other, which are received in and can be pulled out from the housing, comprising: locking means mounted in the first drawer for locking the first drawer to the housing and for locking the second drawer at the same time when the first drawer is locked, and inlet means provided in one of the first and second drawer for inserting documents into the one of the first and second drawer while the first and the second drawer are received in the housing.

When the first drawer is locked with the locking means, the second drawer is locked simultaneously. Therefore, there is no need to install locks to the first and second drawers, respectively, thereby locking and unlocking operation is simplified and improved. Even when the drawers are pulled in the body casing, documents can be inserted and stored in either of the drawers. Operation for inserting and storing documents is improved and the apparatus of user friendliness is obtained.

It is still another aspect of the present invention is to provide a cash storage apparatus comprising: a housing having an engaging opening, a first drawer which is received in the housing and can be pulled out from the housing; a rotary member rotatably mounted in a front wall of the first drawer, a locking member integrally fixed to the rotary member and adapted to be engage with the engaging opening of the housing, and an operating lever integrally fixed to the rotary member, wherein, when the rotary member is turned by operation of the operating lever, the locking member is brought in engagement with the opening of the housing, locking the first drawer to the housing, or is brought out of engagement with the opening of the housing, unlocking the first drawer from the housing, The locking member is brought in or out of engagement with the opening by rotation of the rotary member by the operating lever, locking the drawers to the housing and/or unlocking the same from the housing. Therefore, locking operation of the drawers is simplified and improved, and the apparatus of user friendliness may be obtained.

DETAILED DESCRIPTION OF THE PREFERRED EMBODIMENTS

Now, referring to the attached drawings, FIG. 1 through FIG. 3, a first embodiment of the cash storage apparatus of the present invention will be described.

Figure 1:
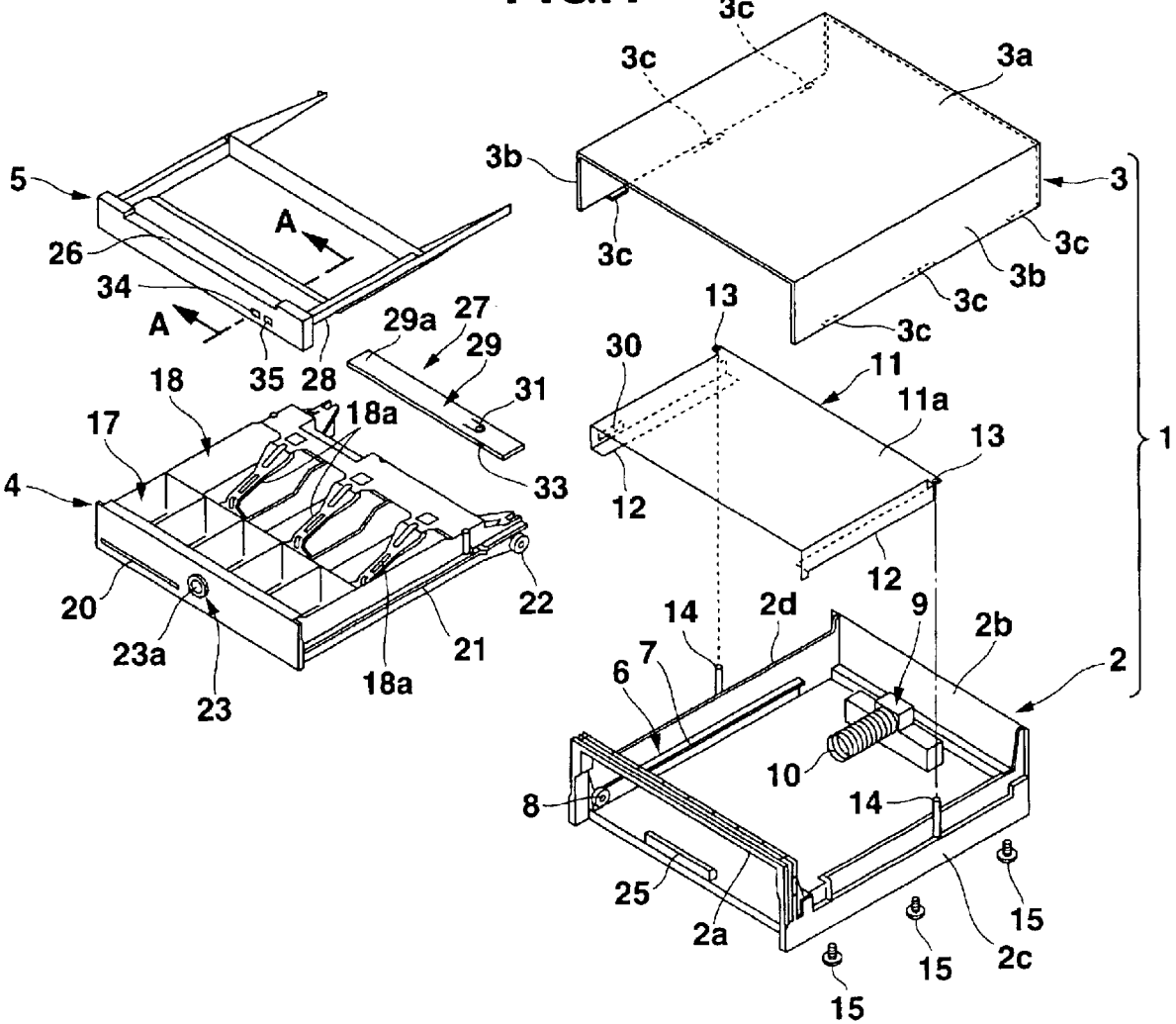
FIG. 1 is an exploded perspective view of a first embodiment of a cash storage apparatus according to the present invention.

FIG. 1 is an exploded perspective view of the first embodiment of the cash storage apparatus according to the present invention. FIG. 2 shows an enlarged cross section of the cash storage apparatus shown in FIG. 1. FIG. 3 shows an enlarged cross section of a main portion taken on line A—A of FIG. 1. The cash storage apparatus comprises a drawer device for an electronic cash register, and has a housing 1 provided at a lower portion of a body of the electronic cash register. The housing 1 is comprised of a body casing 2, and a cover casing 3, which covers side portions and an upper portion of the body casing 2. The body casing 2 is formed of synthetic resin, and is substantially of a box shape with its front and upper portions open. In the body casing 2 are received a first drawer member 4 and a second drawer member 5 which is stacked on the first drawer member 4.

The front portion 2*a* of the body casing 2 is substantially of a rectangle frame, which allows the first and second drawer members 4 and 5 received therein to be pulled out in a frontward direction. The body casing 2 has side walls 2*c*, 2*d* which are a little lower than the front and rear portions 2*a*, 2*b*. Inside the side walls 2*c*, 2*d* of the body casing 2, there are provided first guide members 6 for slidably supporting the first drawer member 4. The first guide members 6 each have a guide rail 7 and a guide roller 8 which is rotatably supported at a front edge of the guide rail 7.

Further, the body casing 2 has a pushing out device 9 mounted on a rear portion of a bottom plate of the body casing 2, which device serves to push out the first drawer member 4 received therein. The pushing out device 9 includes an elastic member or spring member 10 such as a coil spring, which is compressed against the elastic or spring force and locked, when the first drawer member 4 is inserted in the body casing 2 to the full extent, and is released to push out the first drawer member 4 by the elastic or spring force, when an unlock instruction is given to the electronic cash register by a key operation.

On the side walls 2*c*, 2*d* of the body casing 2 is mounted a second guide member 11, which slidably supports the second drawer member 5. More specifically, the second guide member 11 is comprised of a flat plate 11*a* with both sides bent downwards as shown in FIG. 1. The bent portions of the flat plate 11*a* each are provided with rail portions 12, 12 facing to each other, and projections 13, 13 extending in an opposite direction from a rear edge of the flat panel 11*a*.

The second guide member 11 is supported with its rail portions 12, 12 on the side walls 2*c*, 2*d* of the body casing 2 and the projections 13, 13 thereof are attached to bosses14, 14 fixed to the side walls 2*c*, 2*d* of the body casing 2. The second guide member 11 of the above structure sliderably supports with its rail portions 12, 12 the second drawer member 5 at its side portions.

The cover casing 3 to be attached to the body casing 2 is comprised of a flat plate 3*a* with both side portions bent downwards as seen in FIG. 1. When attached to the body casing 2, the cover casing 3 covers the second guide member 11 and the body casing 2. That is, the cover casing 3 is constructed such that, when the cover casing 3 is attached to the body casing 2, the flat plate 3*a* of the cover casing 3 is disposed over the second guide member 11 supported on the body casing 2 and its side walls 3*b*, 3*b* are disposed outside the side walls 2*c*, 2*d* of the body casing 2. The cover casing 3 has plural hooks 3*c* attached to end portions of the side walls 3*b*, 3*b*. The cover casing 3 is fixed to the body casing 2 by fastening hooks 3*c* to a bottom surface of the body casing 2 by means of screws 15.

The first drawer member 4 is for storing cash or money, and is substantially of a box shape with upper side open and has two portions 17 and 18 for storing coins and banknotes respectively. The portion 17 is divided into plural compartments (for example, five compartments) for storing the same sorts of coins, respectively and the portion 18 is also divided into plural compartments (for example, three compartments) for storing the same sorts of banknotes, respectively. The coin storing portion 17 is arranged at its front portion in the first drawer member 4, and the banknote storing portion 18 is arranged at its rear portion in the first drawer member 4, and is provided with banknote holding members 18*a*, as shown in FIG. 1.

Figure 2:
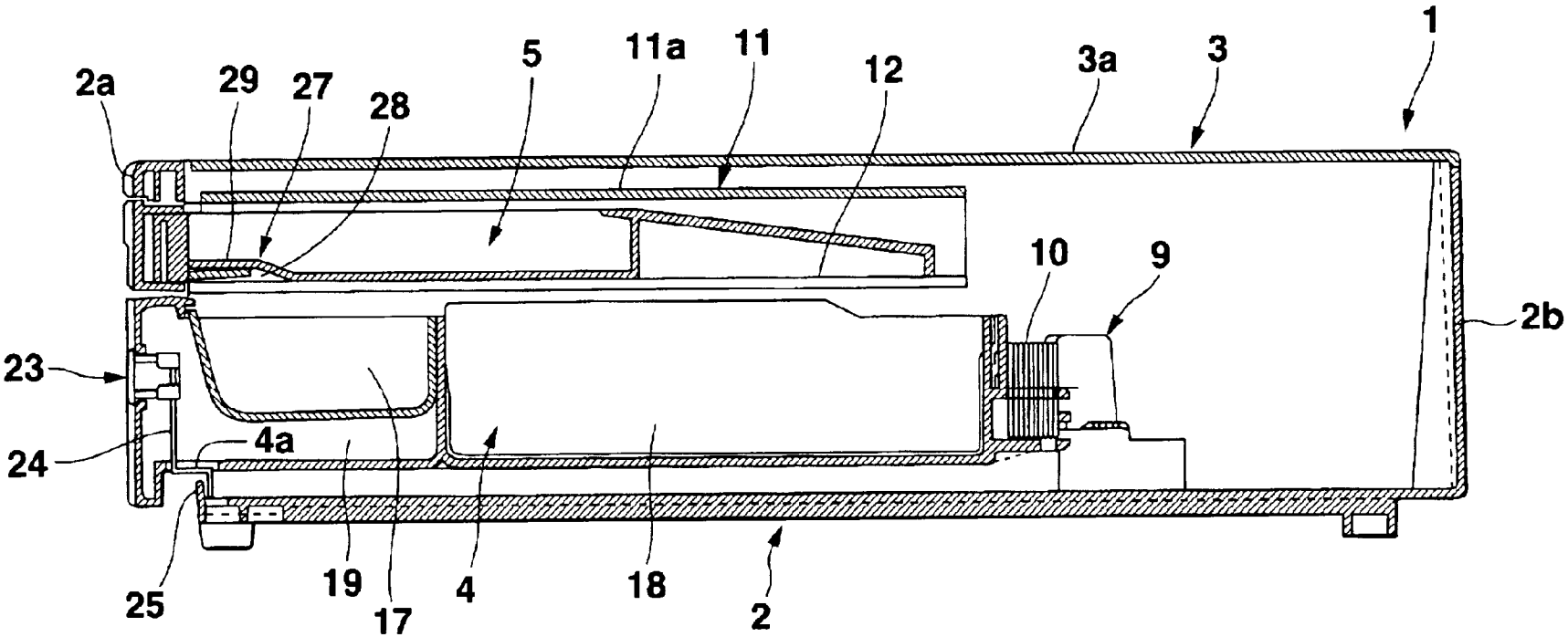
FIG. 2 is an enlarged cross sectional view of the cash storage apparatus shown in FIG. 1.

The coin storing portion 17 is made of an independent casing which is detachably received in the first drawer member 4 at its front part, as shown in FIG. 2. There is left a space or a subsidiary space 19 under the coin storing portion 17 for storing papers such as checks and coupon for goods or banknotes of high denominations, as shown in FIG. 2. In a front wall of the first drawer member 4 is formed an insertion slit 20 for inserting papers and banknotes of high denominations into the subsidiary space 19 with the first drawer member 4 received in the body casing 2 at the innermost position.

As illustrated in FIG. 1, the first drawer member 4 is provided with guide rails 21 and guide rollers 22 at its both sides. The guide rails 21 of the first drawer member 4 move on the guide rollers 8 of the first guide members 6 and the guide rollers 22 of the first drawer member 4 roll along the guide rails 7 of the first guide members 6. These guide roller and guide rail mechanism allows the first drawer member 4 to be smoothly received into and pulled out from the body casing 2, as shown in FIG. 2. The first drawer member 4 is provided with a cylinder-lock 23 in its front wall 2*a*, as shown in FIG. 1.

The cylinder-lock 23 is provided for fastening the first drawer member 4 to the body case 2. The cylinder-lock 23 is mounted in the front wall of the first drawer member 4. A key hole 23*a* for the cylinder-lock 23 is exposed in a surface of the front wall and the cylinder-lock 23 has a stopper 24 fixed to its back side. The stopper 24 of the cylinder-lock 23 has a length to extend through an opening 4*a* formed in a bottom plate of the first drawer member 4. In other words, when a key is inserted into the cylinder-lock 23 through the key hole 23*a* and is turned for a certain angle, the stopper 24 of the cylinder-lock 23 is turned together with the rotation of the key and an end portion of the stopper 24 comes out through the opening 4*a* of the first drawer member 4. On the other hand, the body casing 2 has a projection 25 provided at a front edge of its bottom plate for engaging with the stopper 24 of the cylinder-lock 23. With the first drawer member 4 received in the body casing at the inner most position, when the key is turned in the cylinder-lock 23, the stopper 24 comes out through the opening 4*a* of the bottom plate of the first drawer member 4, and engages with the projection 25 of the body casing 2 to prevent the first drawer member 4 from being pulled out from the body casing 2. On the contrary, when the key is turned in the opposite direction, the stopper 24 of the cylinder-lock 23 is brought out of engagement with the projection 25 of the body casing 2, releasing the first drawer member 4 from the body casing 2.

The second drawer member 5 is used for storing papers such as books, documents, and coupons for goods and is made thinner than the first drawer member 4. The second drawer member 5 has a cut out 26 in its front wall at the upper portion. The cut out 26 of the second drawer member 5 is for inserting the papers when the second drawer member 5 is received in the body casing 2. The second drawer member 5 has a locking member 27 to fastening same to the body casing 2.

Figure 3:
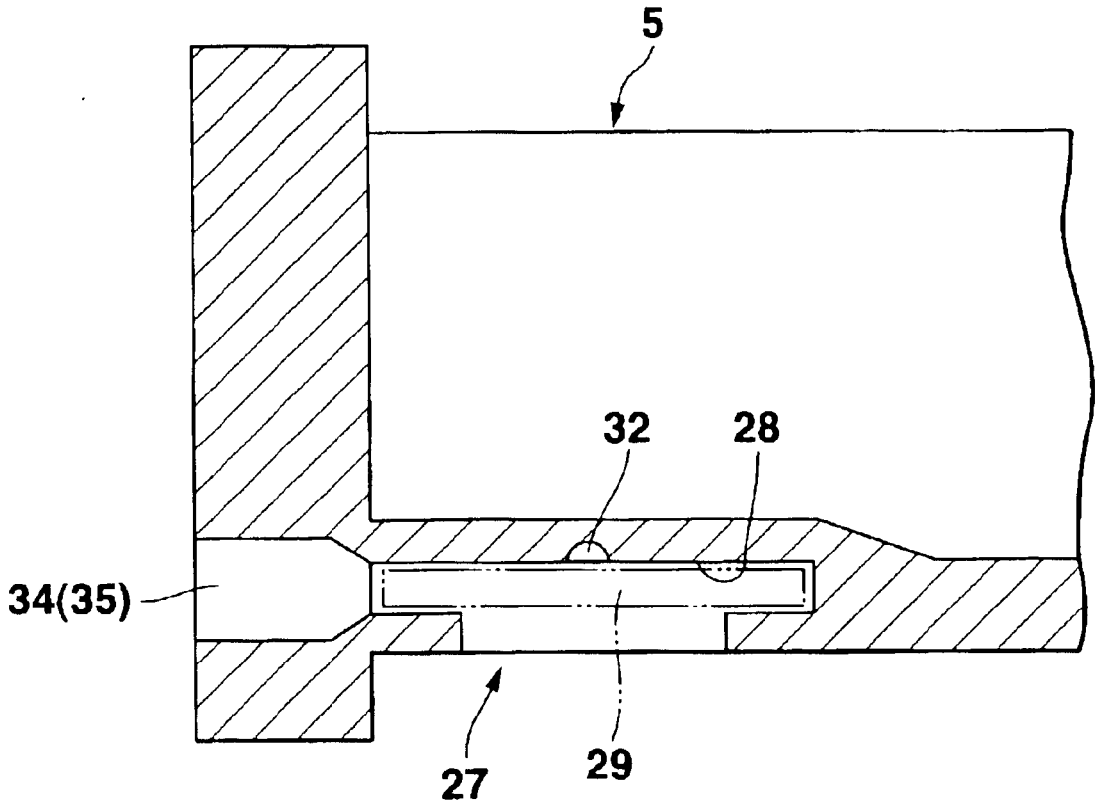
FIG. 3 is an enlarged cross sectional view showing a main structure taken on line A—A of FIG. 1.

As shown in FIG. 1 through FIG. 3, the locking member 27 comprises a sliding plate 29 which is slidably received in a guide channel 28 formed in a bottom plate of the second drawer member 5 at its front side. The sliding plate 29 of the locking member 27 can slidably be moved in the guide channel 28 in a horizontal direction, and the left end 29*a* of the sliding plate 29, when moved to the left (as seen in FIG. 1), comes into an engaging hole 30 formed in the left rail portion 12 of the second guide member 11 to fasten the second drawer member 5 to the body casing 2. On the contrary, when the sliding plate 29 is moved to the right, the left end 29*a* is brought out of engagement with the engaging hole 30 of the second guide member 11, releasing the second drawer member 5 from the body casing 2.

The sliding plate 29 is provided with an elastic projection 31 at its right portion as shown in FIG. 1, and on the other hand a ceiling of the guide channel 28 of the second drawer member 5 has a positioning recess 32 which receives the elastic projection 31 of the sliding plate 29 when the end 29 of the sliding plate 29 is moved to the right and inserted into the engaging hole 30 of the rail portion 12 of the second guide member 11, as shown in FIG. 3. The positioning recess 32 receives the projection 31 of the sliding plate 29 to hold and keep the sliding plate 29 at a position in the guide channel 28. The sliding plate 29 has a mark 33 on its side edge, and the second drawer member 5 has a first opening 34 and a second opening 35 formed in the front wall for confirming the mark 33 of the sliding plate 29. When the sliding plate 29 is move to the left and its end 29*a* is inserted into the engaging hole 30 of the rail portion 12, the mark 33 on the sliding plate 29 can be seen through the first opening 34, which means that the second drawer member 5 is fastened or locked to the body casing 2. When the sliding plate 29 is moved to the right, bringing its end 29*a* out of engagement with the engaging hole 30 of the rail portion 12, the mark 33 on the sliding plate 29 can be seen through the first opening 35, which means that the second drawer member 5 is released from the body casing 2.

Now, the operation of the cash storage apparatus will be described in detail. With the first and the second drawer member 4 and 5 inserted into the body case 2 to the innermost position, when the key is inserted into the cylinder-lock 23 through the key hole 23*a* and turned in a certain direction, the stopper 24 of the cylinder-lock 23 is turned together with the rotation of the key, and the end of the stopper 24 comes out through the opening 4*a* of the first drawer member 4 to engage with the projection 25 of the body case 2, fastening the first drawer member 4 to the body casing 2. On the other hand, the rotation of the key in the cylinder-lock 23 in the opposite direction makes the stopper 24 turn to bring the end of the key out of engagement with the projection 25 of the body casing 2 and holds the stopper 24 within the first drawer member 4, releasing the first drawer member 4 from the body casing 2 and allowing same to be pulled out from the body casing 2. In the above released state of the cash storage apparatus, when the unlock instruction is given to the pushing out device 9 by a key operation, the spring member 10 is released, and the first drawer member 4 is pushed out under the elastic or spring force of the spring member 10.

When the first drawer member 4 is pulled out in the manner mentioned above, the locking member 27 provided at the front portion of the second drawer member 5 can be operated, allowing fastening the second drawer member 5 to the body casing 2 or releasing the fastening. More specifically, when the sliding plate 29 of the locking member 27 is shifted to the left in FIG. 1, the end 29*a* of the sliding plate 29 enters into the engaging hole 30 of the second guide member 11, fastening or locking the second drawer member 4 to the body casing 2. In this state, since the elastic projection 31 of the sliding plate 29 engages with the positioning recess 32 of the second drawer member 5, the sliding plate 29 is held at the predetermined position, and is prevented from shifting to another position. Further, since the mark 33 on the sliding plate 29 can be seen in this state through the first opening 34, a user can confirm that the cash storage apparatus is in the locked state.

When the sliding plate 29 of the locking member 27 is shifted to the right in FIG. 1, the end 29*a* of the sliding plate 29 is brought out of engagement with the engaging hole 30 of the second guide member 11, that is, the elastic projection 31 of the sliding plate 29 is also brought out of engagement with the positioning recess 32 of the second drawer member 5, releasing the second drawer member 4 from the body casing 2. In this state, since the mark 33 on the sliding plate 29 can be seen in this state through the second opening 35, the user can confirm that the cash storage apparatus is not in the locked state. In the cash storage apparatus having the above mentioned mechanism, when the second drawer member 5 is released from the body casing 2, that is, when the second drawer member 5 is brought to the unlocked state by shifting the locking member 27 with the cylinder-lock 23 brought off and the first drawer member 4 being pulled out, the second drawer member 5 can be pulled out without any restriction, even if the first drawer member 4 is received in the body casing 2 and is locked with the cylinder-lock 23. In the meantime, when the second drawer member 5 is locked by the locking member 27 with the first drawer member 4 pulled out, the second drawer member 5 can not be pulled out while the first drawer member 4 is allowed to be pulled out. Therefore, there is no need to install a cylinder-lock on each of the first and second drawer members 4 and 5. When the first drawer member 4 is unlocked with the cylinder-lock 23 installed on the same, the locking member 27 provided on the second drawer member 45 can be operated without any restriction. Further, the locking member 27 cab be operated in a very simple and easy manner, and just requires a sliding operation to operate the same. As described above, since the locking member 27 is easier than the cylinder-lock 23 in its operation, the locking and unlocking operation for the first and the second drawer member 4 and 5 are greatly improved, which allows the user to enjoy convenience in operation of the cash storage apparatus.

Further in the cash storage apparatus of the present invention, since the elastic projection 31 is provided on the sliding plate 27 of the locking member 27 and the positioning recess 32 is formed in the guide channel 28 of the second drawer member 5, when the second drawer member 5 is locked by the sliding plate 29, the sliding plate 27 may be firmly held at the predetermined position and is prevented from shifting to another position to unlock the second drawer member 5 by the engagement between the elastic projection 31 and the positioning recess 32. In the above state or in the locked state, since the mark 33 on the sliding plate 29 can be seen through the first opening 34 of the second drawer member 5, the user can confirm that the cash storage apparatus is brought in the locked state.

Furthermore in the cash storage apparatus of the present invention, even if the first drawer member 4 is received in the body casing 2 and is locked with the cylinder-lock 23 with the second drawer member 5 locked with the locking member 27, or even if both the first drawer member 4 and the second drawer member 5 are received in the body casing 2, it is possible to insert papers such as documents and coupons for goods or banknotes of high denominations into the subsidiary space 19 through the insertion slit 20 formed in the front wall of the first drawer member 4 to store therein, and further to insert the papers such as documents and coupons for goods into the second drawer member 5 through the cut out formed in the front portion of the second drawer member 5 to store therein. As described above, the papers and banknotes may be stored in the first drawer member 4 and/or in the second drawer member 5, regardless of whether these drawer members are received in the body casing 2 or not.

In the above described first embodiment of the cash storage apparatus, a single pair of the sliding plate and the engaging hole are provided for locking the second drawer member 5, but additional pair of a sliding member and an engaging hole having the same function may be provided. In this case the sliding plates may be connected to each other in such manner that when one of them is moved in a direction, then the other one is moved in the opposite direction. For the above connection mechanism, a lack and pinion mechanism or link mechanism may be employed. A knob may be attached to the sliding plate for convenience.

Figure 4:
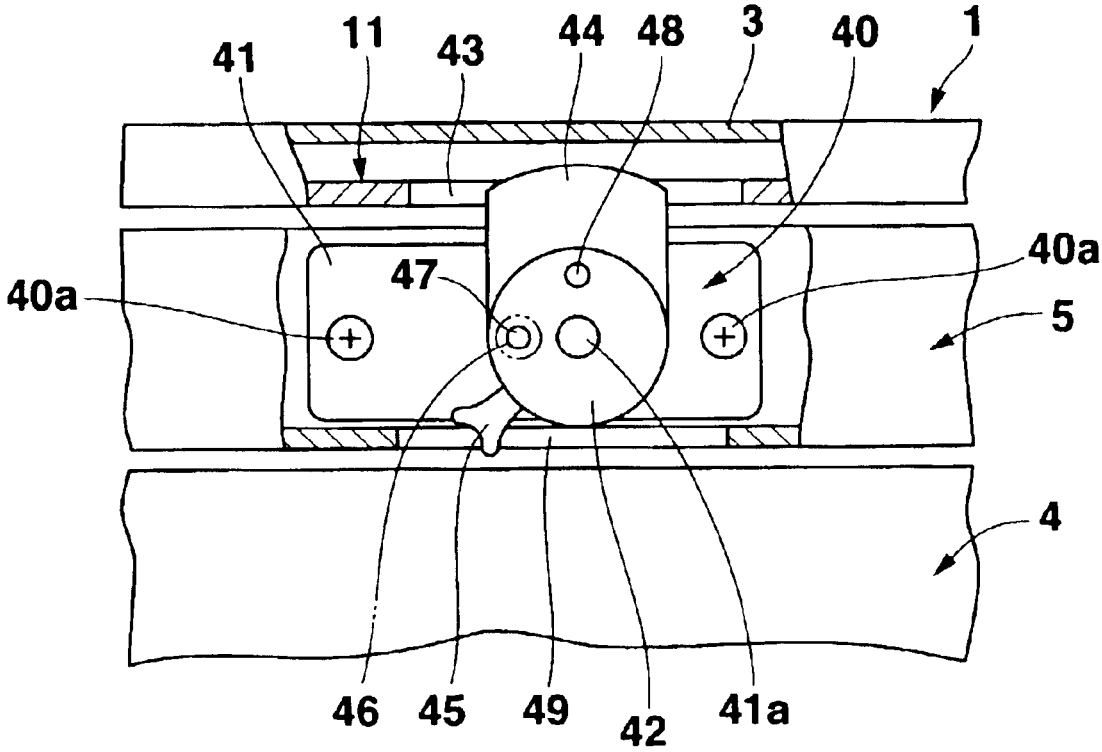
FIG. 4 is a front view showing a main portion of the cash storage apparatus with a second drawing member locked by a locking member in a second embodiment of the cash storage apparatus.
Figure 5:
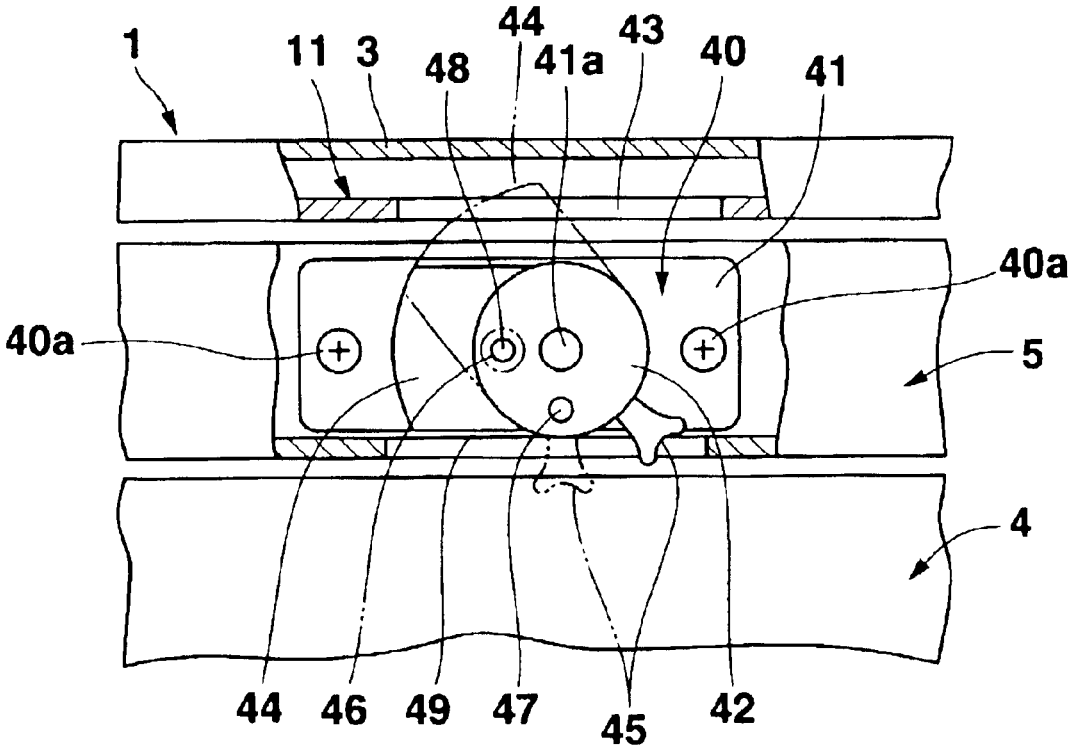
FIG. 5 is a front view of the main portion of the cash storage apparatus with the second drawer member unlocked by the locking member of FIG. 4.

Now, referring to FIG. 4 and FIG. 5, a second embodiment of the cash storage apparatus will be described. In FIG. 4 and FIG. 5, like parts to those of the first embodiment shown in FIG. 1 through FIG. 3 are designated by like reference numbers and detailed description of them will be omitted herein. The second embodiment of the cash storage apparatus has substantially the same mechanisms as those of the first embodiment except for a locking member 40 for fastening or locking the second drawer member 5 to the body casing 2. More specifically, the locking member 40 comprises an attaching plate 41, a locking piece 44, and a limit lever 45. The attaching plate 41 is fixed to an inner surface of the front portion of the second drawer member 5 by means of screws 40*a*. The rotary plate 42 is rotatably attached to a shaft 41*a* stuck on the attaching plate 41. The locking piece 44 is attached to the rotary plate 42 for engaging with an engaging hole formed in the plate of the second guide member 11. The limit lever 45 is attached to the rotary plate 42 and is turned together with the rotary plate 45 to appear through an opening 49 formed in the second drawer member 5.

When the locking piece 44 engages with the engaging hole 43 of the second guide member 11, the limit lever 45 takes a position of seven of the clock as seen in FIG. 4 and does not appear from the opening 49 of the second drawer member 5. When the rotary plate 42 is turned in the counter clockwise direction and a part of the locking piece 44 is brought out of engagement with the engaging hole 43 as shown in broken lines in FIG. 5, the limit lever 45 protrudes through the opening 49 of the second drawer member 5 to take a position to abut to the front portion of the first drawer member 4 and the coin string portion 17. When the rotary plate 42 is further rotated in the counter clockwise direction, bringing the locking piece 44 completely out of engagement with the engaging hole 43 as shown in real lines in FIG. 5, the limit lever 45 does not protrude through the opening 49 of the second drawer member 5 and keeps the position of five of the clock as shown in real lines in FIG. 5.

A confirmation window 46 is formed in the front wall of the second drawer member 5 at a position facing the rotary plate 42. The rotary plate 42 has a first mark 47 showing that the second drawer member 5 is locked, and a second mark 48 showing that the second drawer member 5 is unlocked. Both the first and the second mark provided on the rotary plate 42 at positions facing the confirmation window 46.

The first mark 47 is expressed for instance in red, and is provided at a position such that the mark 47 can be seen through the confirmation window 46 when the locking piece 44 of the locking member 40 is brought into engagement with the engaging hole 43 of the second guide member 11. The second mark 48 is expressed in color other than red, for instance in blue and is provided at a position such that the mark 48 can be seen through the confirmation window 46 when the locking piece 44 of the locking member 40 is brought out of engagement with the engaging hole 43 of the second guide member 11.

In the cash storage apparatus of above structure, when the lock 23 is unlocked and the first drawer member 4 is pulled out from the body casing 2, the limit lever 45 of the locking member 40 can be operated to lock the second drawer member 5 to the body casing 2 or release the lock of the second drawer member 5 from the body casing 2. More particularly, when the rotary plate 42 is turned in the clockwise direction as seen in FIG. 4 by operation of the limit lever 45 of the locking member 40, the locking member 44 attached to the rotary plate 42 is brought into engagement with the engaging hole 43 of the second guide member 11, locking the second drawer member 5 to the body casing 2. In this state, since the first mark 47 on the rotary plate 42 stops at a position facing to the confirmation window 46 of the second drawer member 5, the user can see the red mark through the confirmation window 46 and can confirm from outside the body casing 2 that the second drawer 5 is locked. Further, the limit lever 45 does not extrude from the opening 49 of the second drawer 5 and stays at a position of four of the clock as shown in FIG. 4, the first drawer member 4 can be operated without any limitation.

When the rotary plate 42 is turned in the counter clockwise direction by operation of the limit lever 45 of the locking member 40, the limit lever 45 travels through the opening 49 of the second drawer member 5 to bring the locking piece 44 of the rotary plate 42 out of engagement with the engaging hole 43 of the second guide member 11, unlocking the second drawer member 5 from the body casing 2. At this time, since the rotary plate 42 stops at a position where the second mark (blue mark) of the rotary plate 42 can be seen through the confirmation window 49 of the second drawer member 5, the user can confirm from outside the body casing 2 that the second drawer member 5 is unlocked from the body casing 2. In this state, the limit lever 45 does not extrude from the opening 49 of the second drawer 5 and stays at a position of four of the clock as shown in FIG. 4, the first drawer member 4 can be pulled out.

When only a part of the locking piece 44 is brought in engagement with the engaging hole 43 by operation of the limit lever 45 of the locking member 40 to lock the second drawer member 5 to the body casing 2, as shown by broken lines in FIG. 5, the limit lever 45 extrudes through the opening 49 of the second drawer member 5, taking a position to abut on the front wall and the coin storing portion 17 of the first drawer member 4. As a result, the first drawer member 45 can not be pulled out and the first drawer member 4 can not be received in the body casing 2. From this state, the user can confirm that the second drawer member 4 is incompletely locked by the locking member 40.

In this case, neither the first mark 47 nor the second mark 48 is held at the position facing to the confirmation window 46, and therefore the user can confirm from this state that the second drawer member 4 is incompletely locked.

As described above, in the present cash storage apparatus, when the second drawer member 5 is unlocked by the locking member 40 with the first drawer member 4 pulled out, the second drawer member 5 can be pulled out in the manner similar to in the first embodiment, even if the first drawer member 4 is locked. When the second drawer member 5 is locked in this state by the locking member 40, the second drawer member 5 can not be pulled out while the first drawer member 4 can be pulled out. In addition, since only operation of the limit lever 45 of the locking member 40 is required to rotate the rotary plate 42, the locking operation is very simple in the manner similar to in the first embodiment. As described above, the locking and unlocking operation of the first and the second drawer member 4 and 5 are greatly improved and the present invention provides a cash storage apparatus which can be used conveniently by the user. Further, when the second drawer member 5 is not completely locked by the locking member 40, the first drawer member 4 is prevented from being pulled out by the limit lever 45 of the locking member 40 and the first drawer member 4 can not be received in the body casing 2, and therefore the user can learn from the above state that the second drawer member 5 is not completely locked. As the result, the present invention provides a safer cash storage apparatus.

Now, a third embodiment of the present invention will be described with reference to FIG. 6, in which like parts to those of the first embodiment shown in FIG. 1 through FIG. 3 are designated by like reference numbers and detailed description of them is omitted herein.

The third embodiment of the cash storage apparatus is substantially of the same structure as the first embodiment, except for the locking member 27. The third embodiment of the cash storage apparatus has a lock part 50 in place of the locking member 27 of the first embodiment.

Figure 6:
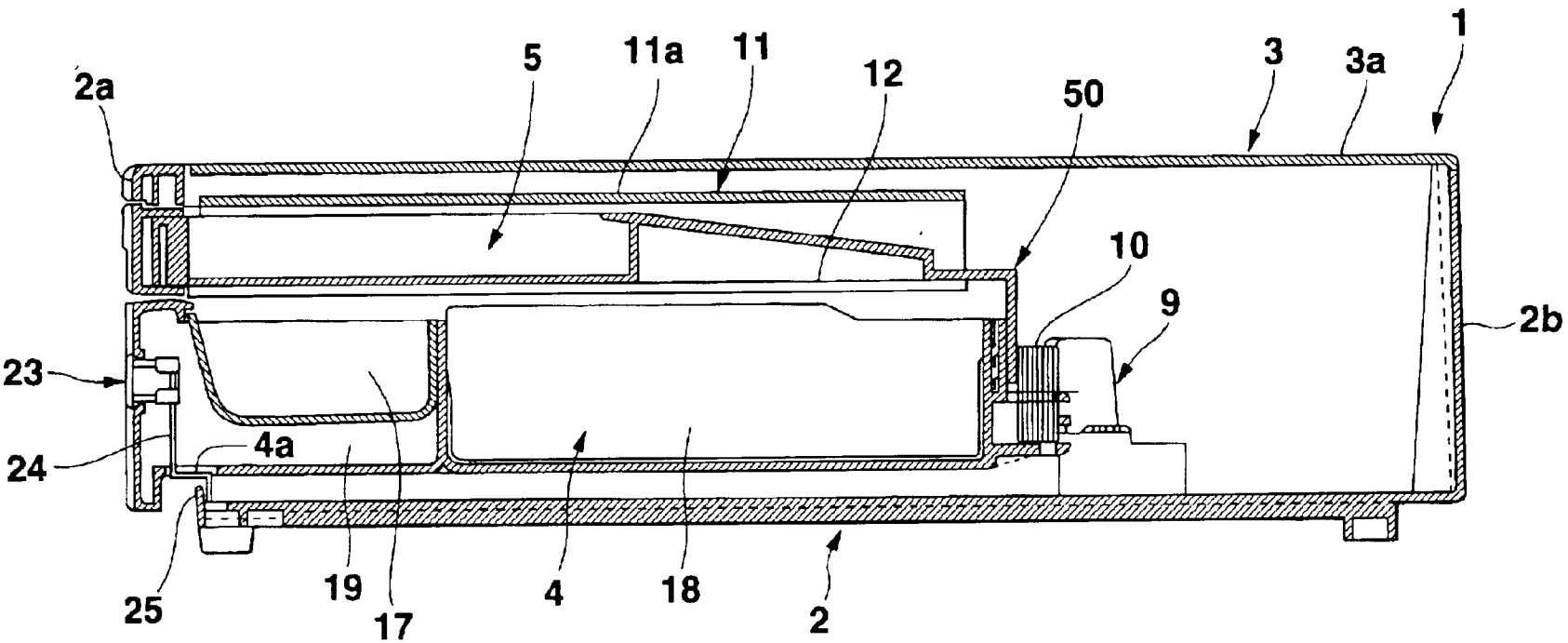
FIG. 6 is an enlarged cross sectional view of a third embodiment of the cash storage apparatus according to the present invention.

As shown in FIG. 6, the lock arm 50 fixed to the rear wall of the second drawer member 5 extends rearward the first drawer member 4 and its end portion at all times is caught between the rear wall of the first drawer member 4 and the spring member 10 of the pushing out member 9 fixed on the bottom plate of the body casing 2. In the third embodiment, the first drawer member 4 is provided with an insertion slit 20 in its front wall for receiving documents such as papers, coupons for goods, and banknotes of high denominations in the subsidiary space 20, and the second drawer member 5 is provided with a cutout 26 in its front wall for receiving therein documents such as papers, coupons for goods, and banknotes of high denominations, as shown in FIG. 1.

In the cash storage apparatus of the above mentioned structure, since the end portion of the lock arm 50 fixed to the second drawer member 5 at all times is inserted between the rear wall of the first drawer member 4 and the spring member 10 of the pushing out device 9, when the first drawer member 4 is inserted into the body casing 2 to the full extent against the spring force of the spring member 10, the rear wall of the first drawer member 4 drags the lock arm 50 to move the second drawer member 4 into the body casing 2. With both the first and the second drawer member 4 and 5 received in the body casing 2 as described above, when the first drawer member 4 is locked by the cylinder-lock 23 mounted in the front wall thereof, the second drawer member 5 is also locked inside the body casing 2. With both the first and the second drawer member 4 and 5 received in the body casing 2, when the cylinder-lock 23 is unlocked, the first drawer member 4 is allowed to be pulled out. In this state, when the unlock instruction is given to the pushing device 9 by key operation, the lock of the spring member 10 is released to push out the first drawer member 4 under its spring force together with the second drawer member 5 through the lock arm 50. As described above, for the cash storage apparatus of the present invention, the user is not required to lock the first and the second drawer member 4 and 5 separately. Since, by locking the first drawer member 4 with the cylinder-lock 23, the second drawer member 5 can be locked at the same time, the cash storage apparatus of the third embodiment is simpler in locking and unlocking operation than the first embodiment. Therefore, the user can use the cash storage apparatus more conveniently. In the cash storage apparatus of the third embodiment, the first and the drawer member 4 and 5 are provided with the insertion slit 20 and the cutout 26 respectively for inserting documents and banknotes, and therefore the user can store documents and banknotes therein, even though the first and the drawer member 4 and 5 are pulled out or received in the body casing 2.

Figure 7:
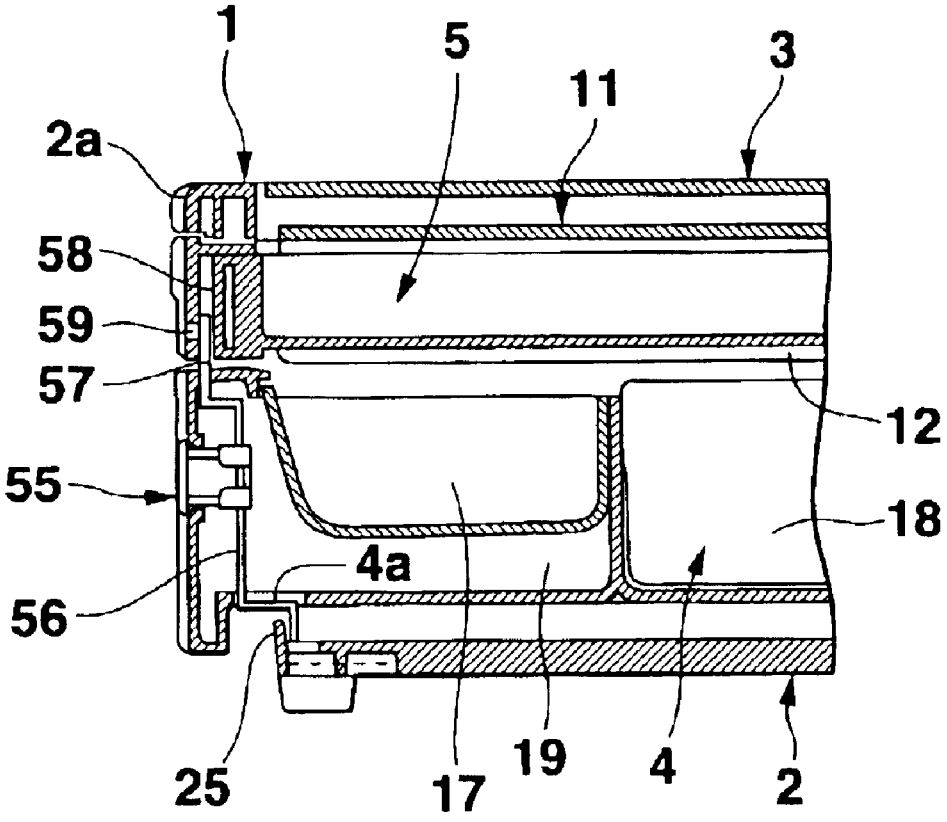
FIG. 7 is an enlarged cross sectional view of a main portion in a forth embodiment of the cash storage apparatus

Now, a fourth embodiment of the present invention will be described with reference to FIG. 7 and FIG. 8, in which like parts to those of the first embodiment shown in FIG. 1 through FIG. 3 are designated by like reference numbers and detailed description of them is omitted herein.

The fourth embodiment of the cash storage apparatus is substantially of the same construction as the first embodiment except for a cylinder-lock 55 mounted in the front wall of the first drawer member 4 for locking the first and the second drawer member 4 and 5.

The cylinder-lock 55 is mounted in the front wall of the first drawer member 4 with its key hole 55*a* exposed in a front surface of the front wall of the first drawer member 4. The cylinder-lock 55 has stoppers 56 and 57 inside the first drawer member 4, as shown in FIGS. 7 and 8. When the cylinder-lock 55 is turned 90 degrees by a key, the stoppers 56 and 57 are turned in the clockwise direction as shown in FIG. 8. Then the stopper 56 engages with the projection 25 provided on the bottom of the body casing 2 at its front side and the stopper 57 is brought into an engaging hole 57 formed in a bottom plate of the second drawer member 5 at its front side.

Figure 8:
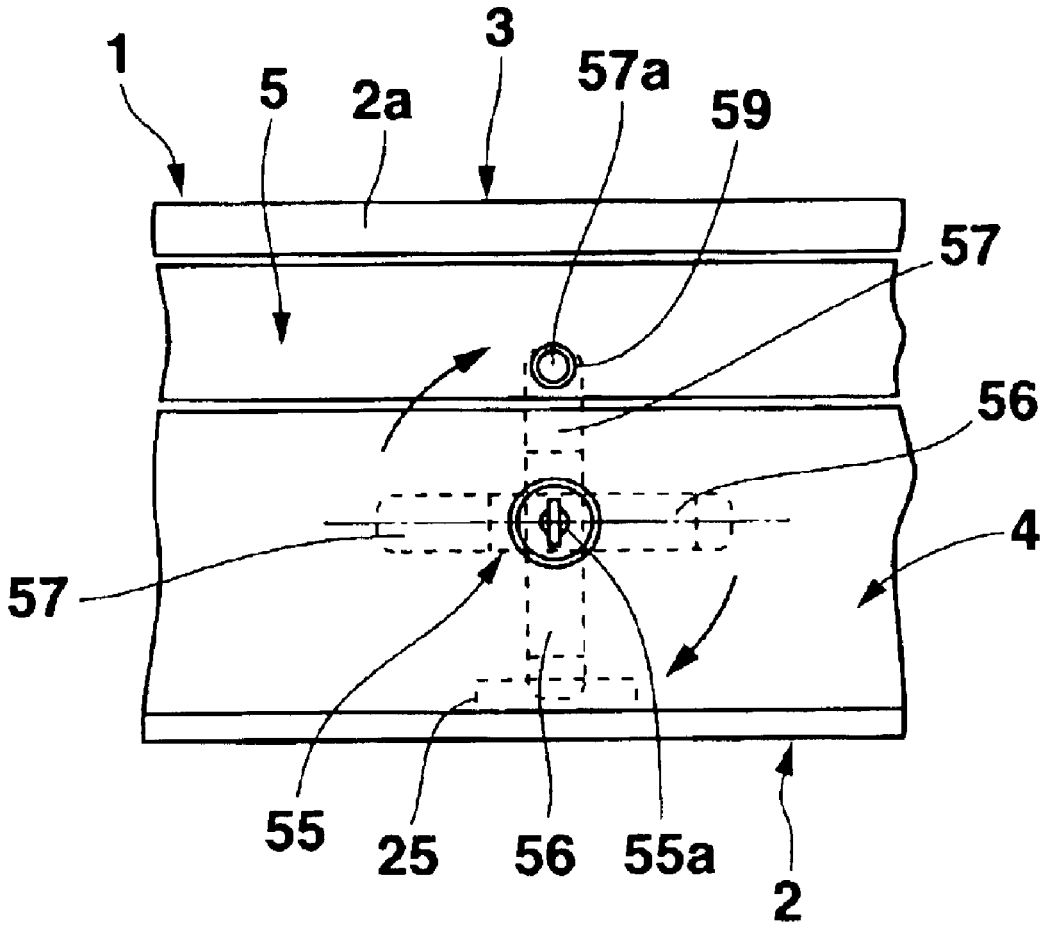
FIG. 8 is a front view of the main portion in the forth embodiment of the cash storage apparatus of FIG. 7.

The second stopper 57 has a mark 57*a* at its end portion as shown in FIG. 8. A confirmation opening is formed in the front wall of the second drawer member 5, through which the mark 57*a* on the second stopper 57 can bee seen when the second stopper 57 is brought in the engaging hole 57. In the forth embodiment, the first drawer member 4 is provided with an insertion slit 20 in its front wall for receiving documents such as papers, coupons for goods, and banknotes of high denominations in the subsidiary space 20, and the second drawer member 5 is provided with a cutout 26 in its front wall for receiving therein documents such as papers, coupons for goods, and banknotes of high denominations, as shown in FIG. 1.

In the cash storage apparatus of the above mentioned structure, when the cylinder-lock 55 is turned 90 degrees with the inserted into the key hole 55*a*, the first and the second stopper 56 and 57 are turned 90 degrees in the clockwise direction. Then the first stopper 56 engages with the projection 25 on the body casing 2 and the second stopper 57 is brought into the engaging hole 58 formed in the second drawer member 5, and therefore both the first and second drawer member 4 and 5 are locked to the body casing 2, simultaneously. When the key is turned 90 degrees in the opposite direction, the first and the second stopper 56 and 57 turn 90 degrees in the counter clockwise direction. Then, since the first stopper 56 is brought out of engagement with the projection 25 on the body casing 2 and at the same time the second stopper 57 is brought out of engagement with the engaging hole 58 of the second drawer member 5, the first and the second drawer member 4 and 5 are unlocked from the body casing 2 simultaneously. In this state, the first and the second drawer member 4 and 5 can be pulled out from the body casing 2 separately.

As described above, the cash storage register of the forth embodiment does not require locking operations respectively for the first and the second drawer member 4 and 5. The first and the second drawer member 4 and 5 can be locked or unlocked simultaneously by one operation of the cylinder-lock 55. In a similar way as in the third embodiment, the locking and unlocking operation of the first and the second drawer member 4 and 5 is greatly improved in the forth embodiment. Further, the first and the second drawer member 4 and 5 can be pulled out separately or independently when these drawer members are unlocked by the cylinder-lock 55, and therefore the cash storage apparatus can be used more conveniently by the user. Furthermore, in the cash storage register of the forth embodiment, since the first and the second drawer member 4 and 5 are provided with the insertion slit 20 and the cutout 26, documents and banknotes can be stored without any restriction in a similar manner as in the first embodiment, even when the first and the second drawer member 4 and 5 are completely received in the body casing 2.

Now, a fifth embodiment of the present invention will be described with reference to FIG. 9.

In the first through the forth embodiment of the cash storage apparatus, the first drawer member 4 is provided with the coin storing portion 17 and the banknote storing portion 18, and the coin storing portion 17 comprises the detachable independent storage casing and the subsidiary space 19 is provided under the coin storing portion 17. As shown in FIG. 9, in the fifth embodiment, a first drawer member 60 may be used in place of the first drawer member 4 of the first through forth embodiments. The first drawer member 60 as shown in FIG. 9 may be used in a combination with the second drawer member 5, and either one of the locking mechanisms for locking the second drawer member 5 in the first through forth embodiments.

Figure 9:
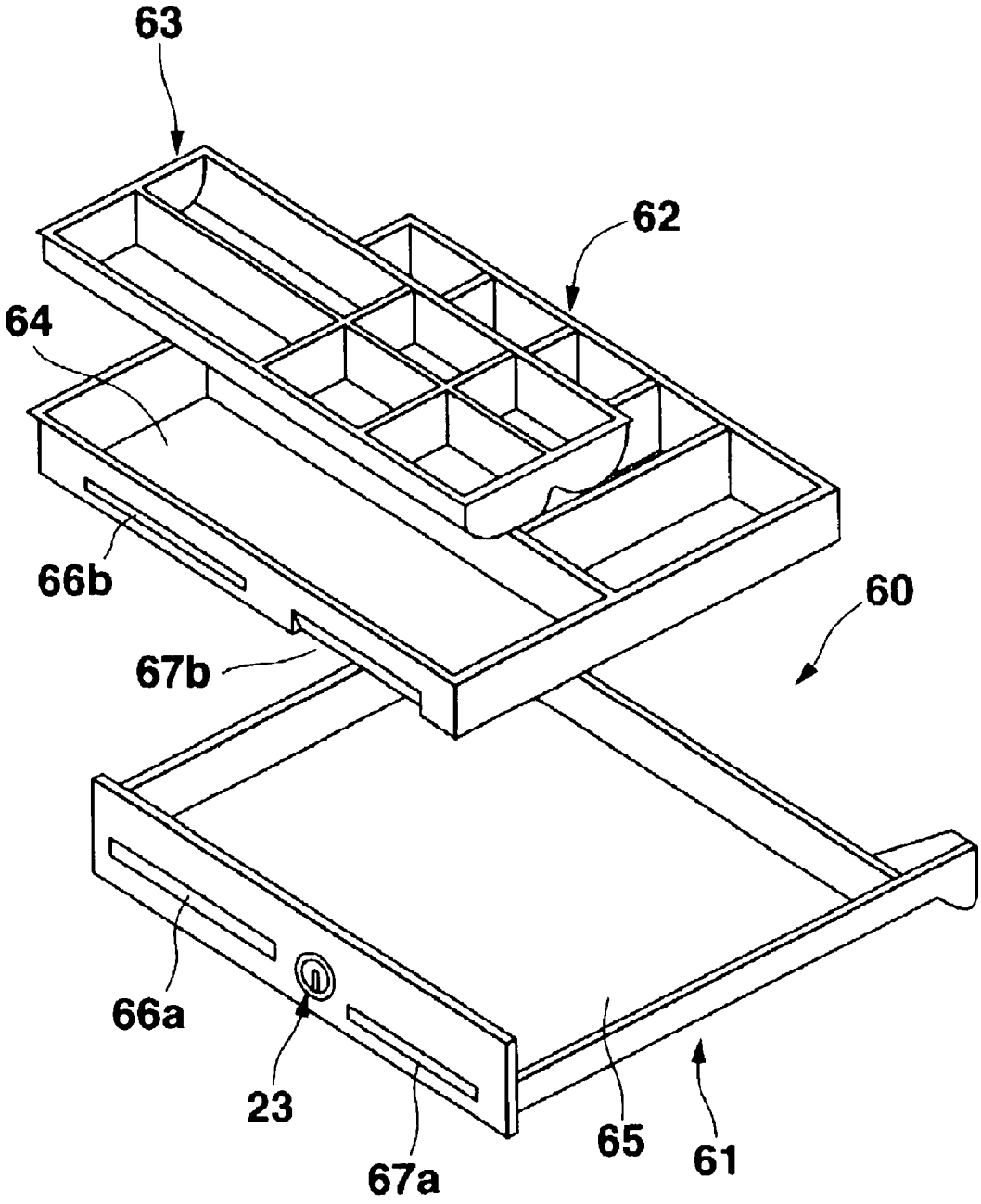
FIG. 9 is an exploded perspective view of a fifth embodiment of the cash storage apparatus of the present invention.

The first drawer member 60 shown in FIG. 9 is provided with a drawer body 61, and the drawer body 61 detachably receives a first storage casing 62. The first storage casing 62 is divided into two portions, one at the front side for storing coins and the other for storing banknotes. A coin storing case 63 is received in the portion of the first storage casing 62 for storing coins. It is preferable that the portion for storing banknotes is provided with a banknote holder similar to that shown in FIG. 1.

The coin storing case 63 is divided into six portions as shown in FIG. 6. On the other hand, the portion of the first storage casing 62 for storing banknotes is divided into five portions. The storage casing 62 is provided with a first subsidiary storage 64 for storing documents and banknotes under the coin storing case 63 received in the storage casing 62. The drawer body 61 is provided with a second subsidiary storage 65 for storing documents and banknotes under the first storage casing 62 received in the drawer body 61. The drawer body 61 has a front wall in which a first and second inlets 66*a* and 67*a* are formed for inserting documents and banknotes. Meanwhile, the first storage casing 62 has a front wall in which a guide opening 66*b* is formed, facing to the first inlet 66*a* of the first drawer body 61 when the first storage casing 62 is received in the drawer body 61. Documents and banknotes can be inserted into the first subsidiary storage 64 through the first inlet 66*a* and the guide opening 66*b*. Further, the front wall of the first storage casing 62 is formed with a guide opening 67*b* facing to the second inlet 67*a* of the first drawer body 61 when the first storage casing 62 is received in the drawer body 61. Documents and banknotes can be inserted into the second subsidiary storage 65 through the first inlet 67*a* and the guide opening 67*b*.

In the fifth embodiment of the above structure, the documents and banknotes can be inserted into the first and second subsidiary storages 64 and 65 of the first drawer member 60 through the first inlet 66*a*, the guide opening 66*b* and the second inlet 67*a*, the guide opening 67*b*. Therefore, the banknotes and documents can be stored safely in the cash storage apparatus, even if the first drawer member 60 is pulled out from the body casing 2. Further, much more documents and banknotes can be stored in the fifth embodiment than in the first drawer member 4 of the first through forth embodiments, and therefore the fifth embodiment may be more conveniently used than the first drawer member 4 of the first through forth embodiments.

In the above mentioned first through fifth embodiments, documents and banknotes can be inserted through the insertion slot 20 and the cutout 26 or through the first and second inlet 66*a* and 67*a*, but not limited to these structure, transmitting devices may be provided to the insertion slot 20 and the cutout 26, the first and second inlet 66*a* and 67*a*, respectively, and the documents and banknotes may be inserted through the transmitting devices.

In the above first through fifth embodiment, the first drawer member 4 and the second drawer member 5 are received in the body casing 2 and the second drawer member 4 is stacked on the first drawer member 4, but more than three drawer members may be received and stacked on each other.

While the invention has been described in detail and with reference to specific embodiments thereof, it will be apparent to one skilled in the art that various changes and modifications can be made therein without departing from the spirit and the scope thereof.

What is claimed is:

1. A cash storage apparatus having a housing and at least a first and a second drawer, one being stacked on the other, which are received in and can be pulled out from the housing, comprising:

a first locking member for locking the first drawer to the housing;

a second locking member for locking the second drawer to the housing, allowing to unlock the second drawer when the first lock is unlocked and the first drawer is pulled out from the housing; and a limiting member for preventing the first drawer from being pushed into the housing, when the second drawer is incompletely locked by the second locking member while the first drawer is pulled out from the housing.

2. The cash storage apparatus as defined by claim 1, further comprising:

an indication for indicating one of a locked state and an unlocked state; and a window provided in a front wall of the second drawer for confirming the indication.

3. The cash storage apparatus as defined by claim 1, wherein the first drawer comprises:

a drawer body;

a first storage casing detachably received in the drawer body;

a coin storing container detachably received in the first storage casing, for storing coins;

a first subsidiary storing portion for storing documents including papers, banknotes, and coupons for goods, provided in the first storage casing under the coin storing container when the coin storing container is received in the first storage casing; and a second subsidiary storing portion for storing documents including papers, banknotes, and coupons for goods, provided in the drawer body under the first storage casing when the first storage casing is received in the drawer body;

wherein the drawer body has a front wall in which a first inlet and a second inlet are formed for inserting documents including banknotes and coupons for goods into the first subsidiary storing portion and the second subsidiary storing portion, respectively.

4. The cash storage apparatus as defined by claim 1, further comprising:

inlet means provided in one of the first and second drawer, for inserting documents into the one of the first and second drawer while the first and the second drawer are received in the housing.

5. The cash storage apparatus as defined by claim 4, further comprising:

a pushing member formed of an elastic material and mounted on the housing;

wherein a rear portion of the second drawer is held between a rear portion of the first drawer and the pushing member, and when the first drawer is pushed into the housing, the rear potion of the first drawer draws the rear portion of the second drawer against a spring force of the pushing member, allowing the second drawer to be received in the housing, whereby both the first and the second drawer stay in the housing with the pushing member compressed.

6. The cash storage apparatus as defined by claim 5, wherein:

the pushing member pushes out both the first and the second drawer from the housing simultaneously under its spring force in response to an unlock operation of the locking means.

7. The cash storage apparatus as defined by claim 4, wherein when the locking means is turned with a key, a stopper fixed to a rear side of the locking means appearing inside the first drawer is turned together with rotation of the locking means to engage with a projection provided inside the housing, locking the first and the second drawer simultaneously.

8. The cash storage apparatus as defined by claim 4, wherein an indication is provided for indicating one of a locked state and an unlocked state, and the front wall of the second drawer is formed with an opening, through which the indication is confirmed.

9. The cash storage apparatus as defined by claim 4, wherein the first drawer comprises:

a drawer body;

a first storage casing detachably received in the drawer body;

a coin storing container detachably received in the first storage casing for storing coins;

a first subsidiary storing portion for storing documents including papers, banknotes, and coupons for goods, provided in the first storage casing under the coin storing container when the coin storing container is received in the first storage casing; and a second subsidiary storing portion for storing documents including papers, banknotes, and coupons for goods, provided in the drawer body under the first storage casing when the first storage casing is received in the drawer body;

wherein the drawer body has a front wall in which a first inlet and a second inlet are formed for inserting documents including banknotes and coupons for goods into the first subsidiary storing portion and the second subsidiary storing portion, respectively.

10. A cash storage apparatus comprising:

a housing having an engaging opening;

first and second drawers which are received in the housing and can be pulled out from the housing;

a rotary member rotatably mounted in a front wall of the first drawer;

a locking member integrally fixed to the rotary member and adapted to be engage with the engaging opening of the housing; and an operating lever integrally fixed to the rotary member; wherein, when the rotary member is turned by operation of the operating lever, the locking member is brought in engagement with the opening of the housing, locking the first drawer to the housing or is brought out of engagement with the opening of the housing, unlocking the first drawer from the housing, and when the first drawer is incompletely locked with the locking member by operation of the operating lever with the second drawer pulled out from the housing, the operating lever abuts to the second drawer, preventing the second drawer from being pushed into the housing.

11. The cash storage apparatus as defined by claim 10, wherein the second drawer receives the first drawer therein, and allows the first drawer to be pulled out from the housing.

12. The cash storage apparatus as defined by claim 10, further comprising:

indications provided on the rotary member for indicating a locked state and an unlocked state, respectively;

wherein when the first drawer is locked or unlocked by rotation of the rotary member, a corresponding indication is provided.

* * * * *